US008205970B2

(12) United States Patent
Lin et al.

(10) Patent No.: US 8,205,970 B2
(45) Date of Patent: Jun. 26, 2012

(54) PRINT HEAD HAVING A POLYMER APERTURE PLATE AND METHOD FOR ASSEMBLING A PRINT HEAD

(75) Inventors: Pinyen Lin, Rochester, NY (US); John R. Andrews, Fairport, NY (US); Mark S. Maynard, Salem, OR (US); Terrance Lee Stephens, Molalla, OR (US); Gregory Lee Friedman, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 378 days.

(21) Appl. No.: 12/640,216

(22) Filed: Dec. 17, 2009

(65) Prior Publication Data

US 2011/0148994 A1 Jun. 23, 2011

(51) Int. Cl.
*B41J 2/045* (2006.01)

(52) U.S. Cl. ..... 347/71

(58) Field of Classification Search ..... 347/68–69, 347/70–72, 54; 310/311, 324, 327
See application file for complete search history.

(56) References Cited

U.S. PATENT DOCUMENTS

| | | | | |
|---|---|---|---|---|
| 5,467,115 | A | 11/1995 | Childers | |
| 5,736,998 | A | 4/1998 | Caren et al. | |
| 5,755,032 | A | 5/1998 | Pan et al. | |
| 5,847,725 | A | 12/1998 | Cleland et al. | |
| 5,852,460 | A | 12/1998 | Schaeffer et al. | |
| 6,443,557 | B1 | 9/2002 | Pan et al. | |
| 6,467,878 | B1 | 10/2002 | Steinfield et al. | |
| 6,575,559 | B2 | 6/2003 | McElfresh et al. | |
| 6,592,206 | B1 | 7/2003 | Suzuki et al. | |
| 6,733,111 | B2 | 5/2004 | Yamamoto | |
| 6,796,639 | B2 | 9/2004 | Sugahara | |
| 6,945,636 | B2 | 9/2005 | Sakaida et al. | |
| 7,520,591 | B2 | 4/2009 | Suzuki | |
| 2010/0295901 | A1 * | 11/2010 | Stephens et al. | 347/54 |
| 2011/0141203 | A1 * | 6/2011 | Gerner et al. | 347/71 |
| 2011/0141204 | A1 * | 6/2011 | Dolan et al. | 347/71 |

* cited by examiner

*Primary Examiner* — Kristal Feggins
(74) *Attorney, Agent, or Firm* — Maginot, Moore & Beck, LLP

(57) ABSTRACT

A method for bonding a polymer layer to an outlet plate for an inkjet print head has been developed that enables the polymer layer to be attached to the outlet plate with little or no bowing of the polymer layer. The method includes aligning recesses in a bonding plate with channels in an outlet plate, interposing a polymer layer between the bonding plate and the outlet plate, and pressing the bonding plate against the polymer layer to bond the polymer layer to the outlet plate.

13 Claims, 5 Drawing Sheets

PRINT HEAD HAVING A POLYMER APERTURE PLATE AND METHOD FOR ASSEMBLING A PRINT HEAD

TECHNICAL FIELD

This disclosure relates generally to inkjet ejectors that eject ink from a print head onto an image receiving surface and, more particularly, to print heads having inkjet ejectors comprised of multiple layers.

BACKGROUND

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates opposite a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper.

FIGS. 5A and 5B illustrate one example of a single inkjet ejector 10 that is suitable for use in an inkjet array of a print head. The inkjet ejector 10 has a body 48 that is coupled to an ink manifold 12 through which ink is delivered to multiple inkjet bodies. The body also includes an ink drop-forming orifice or nozzle 14 through which ink is ejected. In general, the inkjet print head includes an array of closely spaced inkjet ejectors 10 that eject drops of ink onto an image receiving member (not shown), such as a sheet of paper or an intermediate member.

Ink flows from the manifold to nozzle in a continuous path. Ink leaves the manifold 12 and travels through a port 16, an inlet 18, and a pressure chamber opening 20 into the body 22, which is sometimes called an ink pressure chamber. Ink pressure chamber 22 is bounded on one side by a flexible diaphragm 30. A piezoelectric transducer 32 is secured to diaphragm 30 by any suitable technique and overlays ink pressure chamber 22. Metal film layers 34, to which an electronic transducer driver 36 can be electrically connected, can be positioned on either side of piezoelectric transducer 32.

Ejection of an ink droplet is commenced with a firing signal. The firing signal is applied across metal film layers 34 to excite the piezoelectric transducer 32, which causes the transducer to bend. Because the transducer is rigidly secured to the diaphragm 30, the diaphragm 30 deforms to urge ink from the ink pressure chamber 22 through the outlet port 24, outlet channel 28, and nozzle 14. The expelled ink forms a drop of ink that lands onto an image receiving member. Refill of ink pressure chamber 22 following the ejection of an ink drop is augmented by reverse bending of piezoelectric transducer 32 and the concomitant movement of diaphragm 30 that draws ink from manifold 12 into pressure chamber 22.

To facilitate manufacture of an inkjet array print head, an array of inkjet ejectors 10 can be formed from multiple laminated plates or sheets. These sheets are configured with a plurality of pressure chambers, outlets, and apertures and then stacked in a superimposed relationship. Referring once again to FIGS. 5A and 5B for construction of a single inkjet ejector, these sheets or plates include a diaphragm plate 40, an inkjet body plate 42, an inlet plate 46, an outlet plate 54, and an aperture plate 56. The piezoelectric-transducer 32 is bonded to diaphragm 30, which is a region of the diaphragm plate 40 that overlies ink pressure chamber 22. In previously known inkjet ejectors, these plates are metal plates that are brazed to one another with gold.

In some known thermal inkjet print heads, the aperture plate may be a polymer layer in which apertures are formed using laser ablation. The advantages of using a polymer layer include low cost and the ability to taper or otherwise shape the apertures. Using a polymer layer also presents challenges to print head design. In the present art, the outlet plate is generally manufactured from a metal layer, such as stainless steel. The metal layer is etched with openings that fluidly couple the apertures in the polymer aperture plate to a pressure chamber in a body layer once the print head assembly is completed. An adhesive is used to bond the polymer aperture plate to the outlet plate. The adhesive bond is formed with heat and pressure once the two plates are positioned adjacent to one another. Since the apertures in the polymer aperture plate are smaller than the openings in the outlet plate, solid portions of the polymer aperture plate extend over the openings in the outlet plate. The attendant lack of support for these portions as the metallic outlet plate is pressed against the polymer aperture plate produces uneven pressure on the polymer aperture plate and causes the polymer aperture plate to warp. While an ideal print head is usually configured to eject ink droplets perpendicularly to the aperture plate's surface, the warped apertures may eject droplets at different angles, reducing print quality.

The lack of flatness in the aperture plate arising from the application of uneven pressure to polymer layers is known to the art. U.S. Pat. No. 5,467,115 discloses the cutting of extra trenches in the silicon die mounting material to produce unsupported areas of the aperture plate that are symmetrical with regard to the apertures in the polymer aperture layer. These symmetrical unsupported areas help reduce errors in apertures caused by the polymer layer warping. While this method tries to reduce the negative effects caused by warped nozzles, it does not address the underlying problem that the polymer aperture plate is being warped during the print head fabrication process. Additionally, existing thermal inkjet print heads in which the above described compensation method addresses effects at the ends of the plates and not the effects at each aperture. A print head fabrication method for making print heads with flat polymer aperture plates benefits the print head fabrication field.

SUMMARY

A method for forming a polymer aperture plate has been developed that enables the polymer aperture plate to be attached in alignment with outlets in an outlet plate more precisely and to maintain the flatness of the aperture plate. The flatness of the aperture plate is important to avoid print quality defects due to misdirection of the ejected droplets. The method includes aligning recesses in a bonding plate with channels in an outlet plate, interposing a polymer layer between the bonding plate and the outlet plate, and pressing the bonding plate against the polymer layer to bond the polymer layer to the outlet plate. The outlet plate may be a metal plate or other rigid or semi-rigid plate that helps the polymer aperture plate to exhibit sufficient rigidity that the polymer aperture plate adheres to the outlet plate without bowing or other dimensional displacement that adversely impacts the jetting of ink droplets from the apertures in the polymer aperture plate. Likewise, a bonding plate exhibits similar rigidity to apply sufficient pressure for bonding without adverse dimensional displacement.

The method produces inkjet print heads that can take advantage of the economy of polymer layers. The inkjet print head includes a body layer in which a plurality of pressure chambers is configured, an outlet plate configured with a plurality of channels, and a polymer layer having apertures that are aligned with the channels in the outlet plate, the polymer layer deviating no more than about 1.5 μm on either side of a straight line across an opening in a channel in the outlet plate.

BRIEF DESCRIPTION OF THE DRAWINGS

The foregoing aspects and other features of fabricating a polymer aperture plate and how the polymer aperture plate is attached to a rigid inkjet stack are explained in the following description, taken in connection with the accompanying drawings.

DETAILED DESCRIPTION

Figure 1:
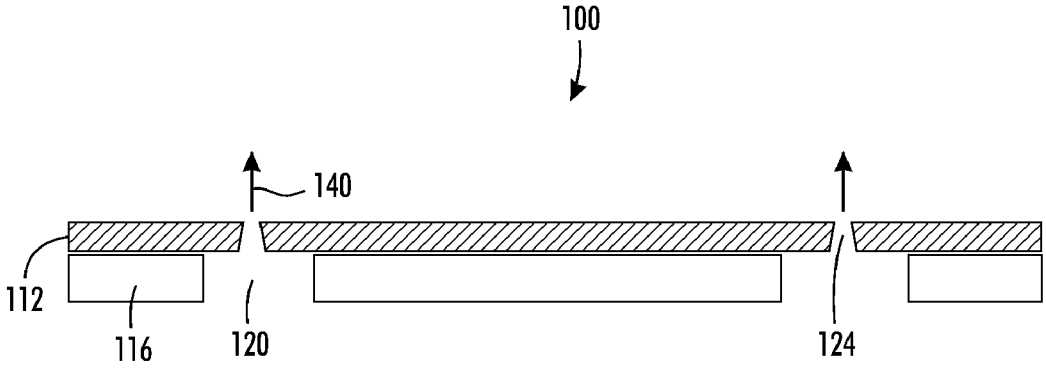
FIG. 1 depicts a flat polymer aperture layer bonded directly to an outlet plate.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, etc. Devices of this type can also be used in bioassays, masking for lithography, printing electronic components such as printed organic electronics, and for making 3D models among other applications. The word "ink" can refer to wax-based inks known in the art but can refer also to any fluid that can be driven from the jets including water-based solutions, solvents and solvent based solutions, and UV curable polymers. The word "polymer" encompasses any one of a broad range of carbon-based compounds formed from long-chain molecules including thermoset polyimides, thermoplastics, resins, polycarbonates, and related compounds known to the art. The word "metal" may encompass either single metallic elements including, but not limited to, copper, aluminum, or titanium, or metallic alloys including, but not limited to, stainless steel or aluminum-manganese alloys. A "transducer" as used herein is a component that reacts to an electrical signal by generating a moving force that acts on an adjacent surface or substance. The moving force may push against or retract the adjacent surface or substance.

FIG. 1 depicts a combination 100 of a flat polymer aperture plate 112 bonded to an outlet plate 116. The outlet plate has outlet channels 120 that extend through the plate. The polymer aperture plate 112 has nozzles 124 that have been formed through the layer. The polymer aperture plate is substantially flat along its length including the portions that overlie channel openings 120 in the outlet plate 116. Each nozzle 124 corresponds to an outlet channel 120. The nozzles and channels enable ink to flow through the outlet plate 116 and to be ejected from the nozzle 124 as a droplet in direction 140.

Figure 2:
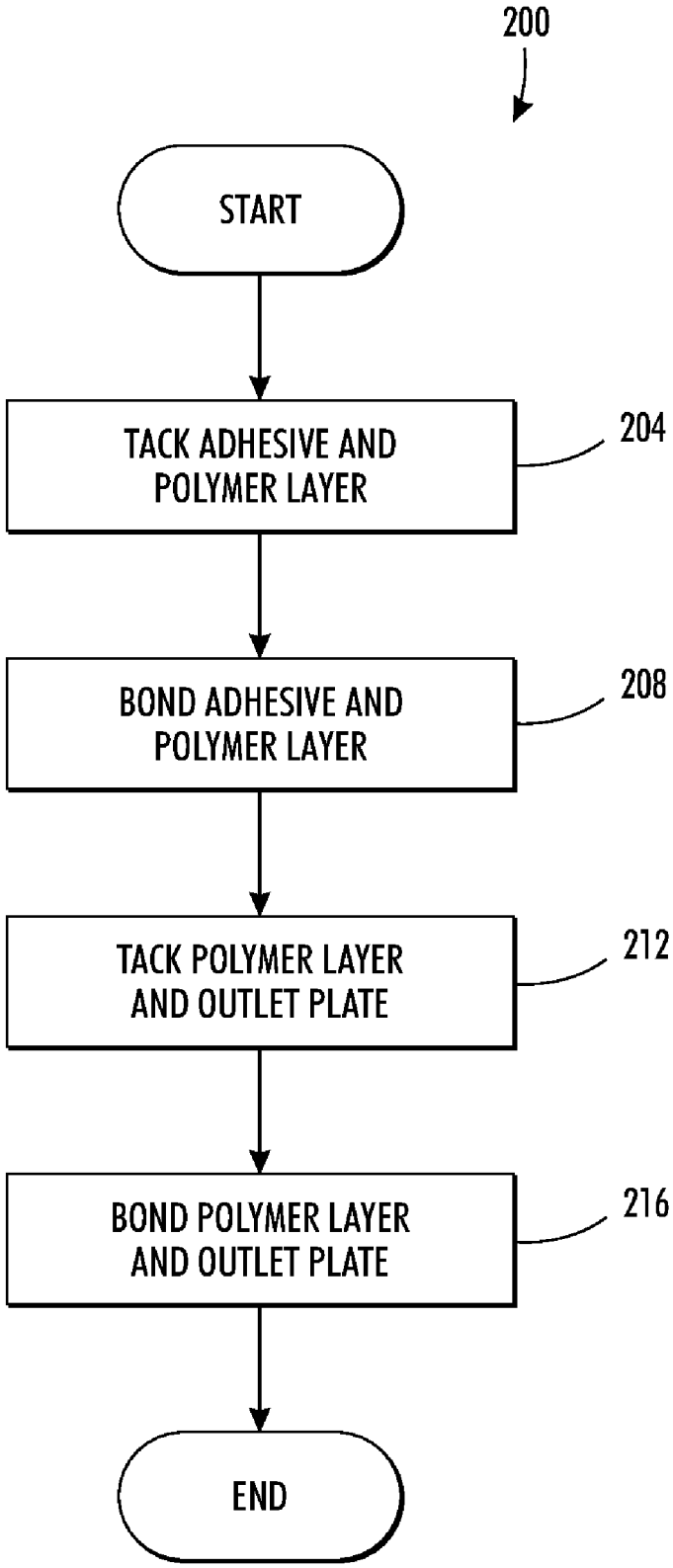
FIG. 2 is a flow diagram of the process used to bond a polymer layer to an outlet plate.

An example process capable of producing the bonded polymer layer and outlet plate of FIG. 1 is depicted in FIG. 2. The process 200 of FIG. 2 is an embodiment that uses an adhesive material to bond the polymer layer to the outlet plate. The adhesive material is first tacked to the polymer layer (block 204) and then bonded to the polymer layer (block 208). The tacking process of block 204 aligns the adhesive material with the polymer layer, and the bonding process of block 208 laminates the two layers together. Then the polymer layer with the bonded adhesive is tacked to the outlet plate with the adhesive material placed between the polymer layer and the outlet plate (block 212). The tacking process aligns the polymer layer with the outlet plate. The tacked outlet plate and polymer layer are then bonded together (block 216). The bonding process hermetically seals the polymer layer and outlet plate together to produce an outlet plate and polymer layer combination that is at least 25 mm in length.

Figure 3:
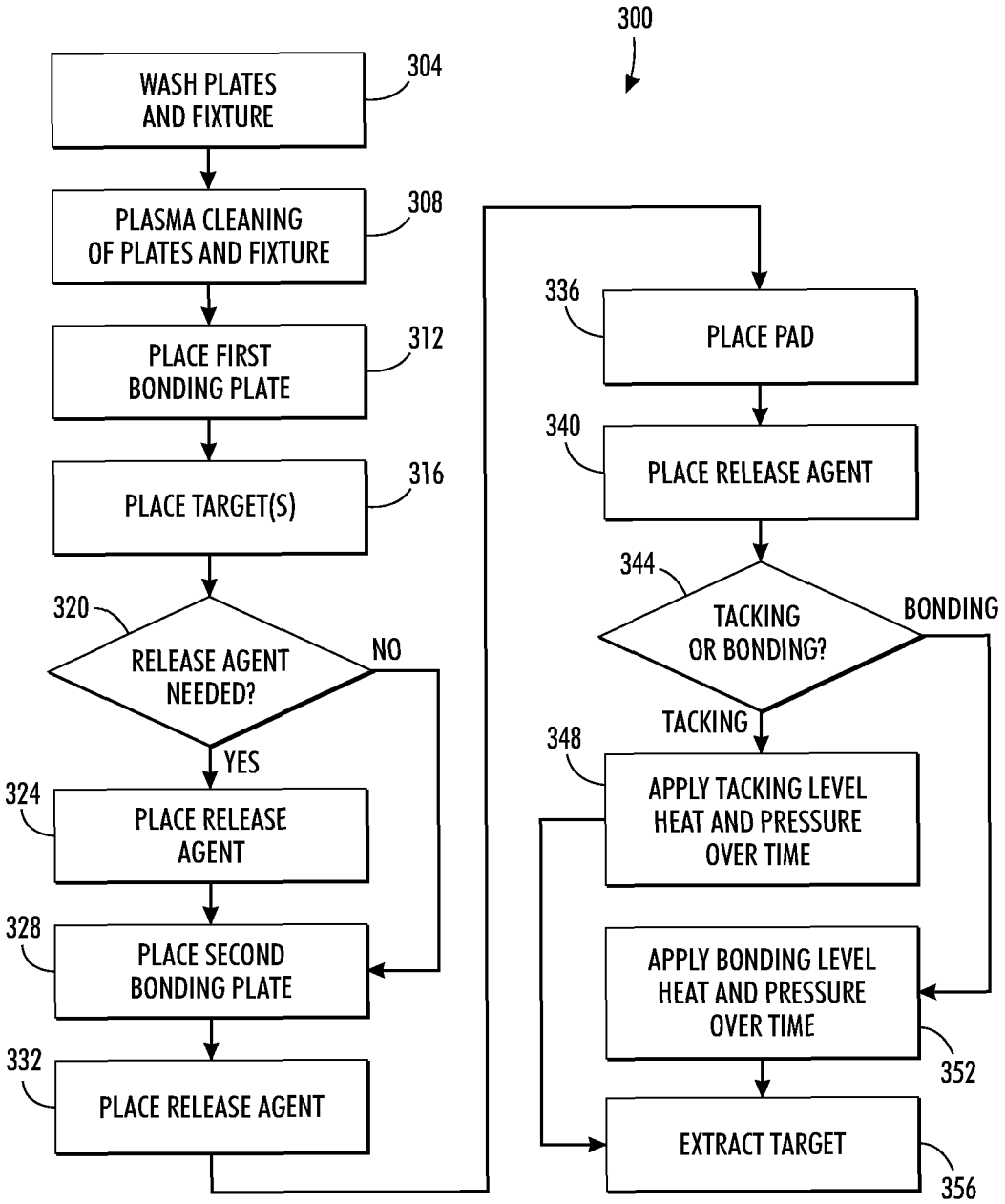
FIG. 3 is a flow diagram of tacking and bonding processes used to tack or bond two or more material layers together.

A flow diagram that describes an example of a process for tacking the polymer layer and adhesive material (FIG. 2 block 204) is depicted in FIG. 3. The tacking process begins by cleaning a fixture, two bonding plates, and the outlet plate in a detergent spray wash and ultrasonic wash cycle to clean larger contaminants from their surfaces (block 304). The fixture and two bonding plates are then exposed to a plasma cleaner to remove thin-film contamination and leave their surfaces exposed (block 308). The first bonding plate is then aligned and placed above the fixture (block 312). The fixture is a superstructure providing a base with a plurality of pins extending vertically from the base. The pins are arranged to align with tooling holes formed through various plates used in the tacking process. The first bonding plate is placed on the fixture with the fixture pins extending through tooling holes formed through the first bonding plate. The first bonding plate preferably has a uniformly flat surface except for the tooling holes and is preferably made from a metal such as stainless steel.

The tacking process continues by placing the two target layers above the first bonding plate (block 316). In this instance, the target layers are the polymer layer and the adhesive material. The polymer layer is placed above the first bonding plate with a release agent coating on the polymer layer facing the first bonding plate. The release agent coating may be a fluoropolymer material and the release agent prevents the polymer layer from adhering to the first bonding plate during the tacking process. The polymer layer has tooling holes that accept the fixture pins and align the polymer layer with the first bonding plate. The adhesive is then placed above the polymer. Suitable adhesive materials include double sided adhesive tapes having thermoset or thermoplastic adhesives on opposite sides of a thermoset or thermoplastic polymer core. Alternatively, the adhesive material can be a thermoplastic or thermoset adhesive. The adhesive material is positioned using thermal tape capable of withstanding the temperatures of the tacking process. The thermal tape is applied to the edge of the adhesive, leaving the portions of the adhesive that contact the output plate in the process of FIG. 2 exposed.

Because the adhesive should not adhere to the bonding plates used in the tacking and bonding processes, a release agent covers the exposed surface of the adhesive material (block 320). The release agent is applied above the adhesive, typically as a thin sheet of a fluoropolymer, such as polytetrafluoroethylene (block 324). The release agent prevents the adhesive from tacking to a second bonding plate, which is placed above the adhesive and polymer layer in alignment with the fixture pins (block 328). The second bonding plate may be identical in form to the first bonding plate and provides a uniform upper surface for the tacking process. Another layer of release agent, preferably a thin polyimide film, such as Upilex (formed from biphenyl tetracarboxylic dianhydride monomers), is applied above the second bonding plate (block 332). A pad is placed over the release agent coating of the second bonding plate (block 336). The pad allows for an even transfer of pressure to the target layers during the tacking process. In the embodiment of FIG. 3, this pad is made of a flexible material capable of withstanding the pressure and temperature of the tacking process, such as silicone rubber, and is 6.35 mm thick. A layer of the same release agent coating the second bonding plate is applied over the upper surface of the pad (block 340).

The assembly formed in blocks 312-340 is placed in a heated pressure chamber in order to tack the polymer layer to the adhesive (block 344). Pressure is applied vertically through the pad, second bonding plate, polymer layer, adhesive, first bonding plate, and the fixture. The combination of heat and pressure causes the adhesive to tack to the polymer layer. In the example embodiment of FIG. 3, the tacking is complete after 3 minutes of exposure to a temperature of 250° C. at a pressure of 150 psi (block 348). The polymer layer with tacked adhesive is extracted from the fixture assembly (block 352). The release agent coatings on the exposed surfaces of the polymer layer and adhesive material allow the bonding plates to be removed without distorting the polymer layer and adhesive. The thermal tape used in the tacking process may be removed as the tacked adhesive material remains aligned with the polymer layer. The layer of release agent between the second bonding plate and the pad allows the pad to be removed as well. The fixture, bonding plates, and pad may be reused in another tacking process.

The flow diagram of FIG. 3 also describes an example of a process for permanently bonding the tacked adhesive to the polymer layer (FIG. 2 block 208). The process begins with the fixture and bonding plates being washed (block 304) and plasma cleaned (block 308) in the same manner described above in order to remove contaminants. The fixture, bonding plates, and pad used for the tacking process may also be used in the bonding process.

The bonding process of FIG. 3 continues with the first bonding plate being aligned and placed above the fixture with the fixture pins passing through tooling holes formed in the first bonding plate surface (block 312). The target is then placed above the first bonding pad (block 316). In this case, the target is the tacked polymer layer and adhesive material. The polymer layer is aligned with the first bonding plate and is placed above the plate with the fixture pins extending through tooling holes in the polymer layer. The polymer layer's thin coating of release agent prevents the polymer layer from adhering to the first bonding plate during the bonding process. The adhesive material already has a release agent layer applied to its exposed surface, obviating the need for application of release agent (block 320). The second bonding plate is placed above the adhesive material with the fixture pins passing through tooling holes formed in the second bonding plate surface (block 328). As with the tacking process, a thin layer of release agent is applied to the second bonding plate (block 332), a pad is placed above the second bonding plate (block 336), and a thin layer of release agent is applied to pad's upper surface (block 340).

The assembly formed in blocks 312-340 is placed in a heated pressure chamber in order to bond the polymer layer to the adhesive (block 344). Pressure is applied vertically through the pad, second bonding plate, polymer layer, adhesive, first bonding plate, and the fixture. The combination of heat and pressure causes the adhesive to bond to the polymer layer. In the example embodiment of FIG. 3, the bonding is complete after 30 minutes of exposure to a temperature of 290° C. at a pressure of 350 psi (block 348). The polymer layer with bonded adhesive is extracted from the fixture assembly (block 352). The bonding process permanently laminates the adhesive to the polymer layer. The release agent coatings on the exposed surfaces of the polymer layer and adhesive material allow the bonding plates to be removed without distorting the polymer layer and adhesive. The layer of release agent coating the exposed adhesive surface may be removed after the bonded adhesive and polymer layer are extracted from the bonding plates. The layer of release agent between the second bonding plate and the pad enables the pad to be removed as well. The fixture, bonding plates, and pad may be reused in another bonding process.

A process of tacking the polymer layer with the bonded adhesive material to the outlet plate (block 211, FIG. 2) may also be described with reference to FIG. 3. The tacking process of the polymer layer and the outlet plate is similar to the process used to tack the polymer layer and adhesive material that was described above. The process begins with the fixture and bonding plates being washed (block 304) and plasma cleaned (block 308) in the same manner described above in order to remove contaminants. The outlet plate, which is typically metallic, also undergoes the washing and plasma cleaning process of block 304 and 308. The fixture, bonding plates, and pad used for tacking and bonding the polymer layer and adhesive material may also be used for tacking the polymer layer and outlet plate.

The bonding process of FIG. 3 continues with the first bonding plate being aligned and placed above the fixture, with the fixture pins passing through tooling holes formed in the first bonding plate's surface (block 312). The target outlet plate and polymer layer are then placed above the first bonding pad (block 316). The outlet plate is placed above the first bonding pad with the fixture pins passing through tooling holes in the outlet plate to aligning it with the bonding plate. The polymer layer is placed above the outlet plate with the adhesive material facing the outlet plate. The polymer layer is aligned with the outlet plate using thermal tape capable of withstanding the temperatures of the tacking process. The exposed surface of the polymer layer already has a coating of release agent, obviating the need to apply more release agent (block 320). The second bonding plate is placed above the polymer layer with the fixture pins passing through tooling holes formed in the second bonding plate surface (block 328). As with the tacking and bonding processes discussed above, a thin layer of release agent is applied to the second bonding plate (block 332), a pad is placed above the second bonding plate (block 336), and a thin layer of release agent is applied to pad's upper surface (block 340). The assembly formed in blocks 312-340 is placed in a heated pressure chamber in order to tack the polymer layer to the outlet plate (block 344). Pressure is applied vertically through the pad, second bonding plate, polymer layer, adhesive, outlet plate, first bonding plate, and the fixture. The combination of heat and pressure causes the adhesive to tack to the surface of the outlet plate. In the example embodiment of FIG. 3, the tacking is complete after 3 minutes of exposure to a temperature of 250° C. at a pressure of 150 psi (block 348).

The tacked polymer layer and outlet plate combination is extracted from the fixture assembly (block 352). The release agent coating on the exposed surfaces of the polymer layer enables the second bonding plate to be removed without distorting the polymer layer and the outlet plate is removed from the first bonding plate. The thermal tape used in the tacking process may be removed as the tacked polymer layer remains in alignment with the outlet plate. The layer of release agent between the second bonding plate and the pad allows the pad to be removed as well. The fixture, bonding plates, and pad may be reused in another tacking process.

A process for bonded the polymer layer with bonded adhesive material that is tacked to the outlet plate (block 216, FIG. 2) may also be described with reference to FIG. 3. The process begins with the fixture and bonding plates being washed (block 304) and plasma cleaned (block 308) in the same manner described above in order to remove contaminants. The fixture, bonding plates, and pad used for the tacking process may also be used in the bonding process.

The bonding process continues with the first bonding plate being aligned and placed above the fixture with the fixture pins passing through tooling holes formed in the first bonding plate's surface (block 312). The target is then placed above the first bonding pad (block 316). In this case, the target is the tacked outlet plate and polymer layer. The outlet plate is aligned with the first bonding plate and is placed above the first bonding plate with the fixture pins extending through tooling holes in the outlet plate. The polymer layer faces up from the outlet plate. The polymer layer already has a release agent layer applied to its exposed surface, obviating the need for application of release agent (block 320). The second bonding plate is placed above the polymer layer with the fixture pins passing through tooling holes formed in the second bonding plate's surface (block 328). As with the tacking process, a thin layer of release agent is applied to the second bonding plate (block 332), a pad is placed above the second bonding plate (block 336), and a thin layer of release agent is applied to pad's upper surface (block 340).

The assembly formed in blocks 312-340 is placed in a heated pressure chamber in order to bond the outlet plate to the polymer layer (block 344). Pressure is applied vertically through the pad, second bonding plate, polymer layer, adhesive, outlet plate, first bonding plate, and the fixture. The combination of heat and pressure causes the adhesive to bond to the outlet plate. In the example embodiment of FIG. 3, the bonding is complete after 30 minutes of exposure to a temperature of 290° C. at a pressure of 350 psi (block 348). The bonded outlet plate and polymer layer combination is extracted from the fixture assembly (block 352). The bonding process forms a hermetic seal between the polymer layer and outlet plate. The layer of release agent between the second bonding plate and the pad allows the pad to be removed as well. The fixture, bonding plates, and pad may be reused in another bonding process.

The processes disclosed in FIG. 2 and FIG. 3 are merely illustrative of possible embodiments for tacking and bonding the polymer layer, adhesive, and outlet plate, and alternative processes are envisioned. A possible alternative process could tack and bond the adhesive material to the outlet plate before tacking and bonding to the polymer layer. In another alternative process, the polymer layer may be formed from a thermoset compound or another form of polymer that is self-adhering. These materials may adhere directly to an outlet plate, and this allows for the process of FIG. 2 to begin at block 212 by tacking the polymer layer directly to the outlet plate. Another possible embodiment could use polymers that do not require a separate tacking process to align the polymer layer with the outlet plate. These alternatives only require a bonding process, and not a tacking process. Some examples of adhesives that do not require a tacking operation are dispensed liquid adhesives or transfer film adhesives. Active optomechanical alignment of the adhesives and plates may used for one or all of the alignments rather than the tooling pin and slot alignment described above.

Figure 4A:
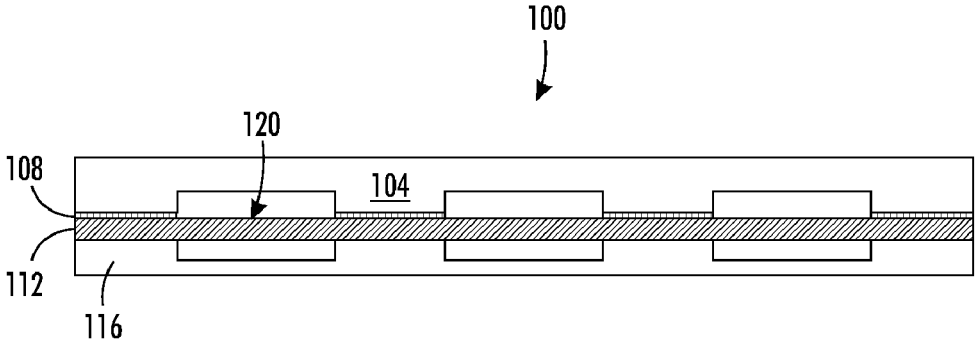
FIG. 4A depicts a bonding plate being used to bond a polymer layer directly to an outlet plate.
Figure 4B:
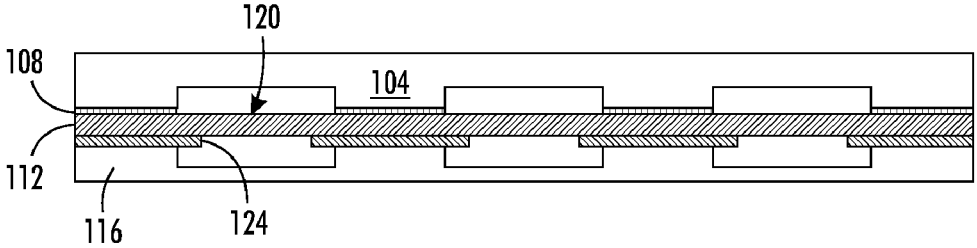
FIG. 4B depicts a bonding plate being used to bond a polymer layer to an outlet plate with a separate layer of adhesive.

Two possible assemblies of the process depicted in FIG. 2 are depicted in FIG. 4A and FIG. 4B. FIG. 4A depicts one assembly of layers for bonding the polymer layer 412 to the outlet plate 416 while the polymer layer remains flat. In this embodiment, a rigid plate called a bonding plate 404 is etched or otherwise formed to match the patterns placed in the outlet plate. Thus, recesses in the bonding plate match the channels contained in the outlet plate. In one embodiment the bonding plate may be built from outlet plates. Both the outlet plate and bonding plate may be formed from stainless steel, but could be made from other metals, ceramics, glass, or plastics. The bonding plate is then positioned to align the bonding blank recesses with the outlet plate channels. The outlet plate in FIG. 4A is shown in a cross-sectional view through the channels in the outlet plate.

Referring again to FIG. 4A, the polymer layer is placed between the bonding plate and the outlet plate in the final position in which the polymer layer is bonded to the outlet plate. The polymer layer may be formed from a polyimide material or other polymers including polyetherether ketone, polysulfone, polyester, polyethersulfone, polyimideamide, polyamide, polyethylenenaphthalene, etc. The polymer layer can be a self-adhesive thermoplastic or have a thin layer of adhesive deposited on the side of the polymer layer that is placed in contact with the outlet plate. Pressure and heat are applied to the bonding plate, polymer layer, and outlet assembly 400 in order to bond the polymer layer to the outlet plate. In one embodiment having a thin thermoplastic adhesive layer, a pressure of 350 psi is applied at 290° C. for 30 minutes. During the bonding process, the bonding plate places pressure against all of the same portions of the polymer layer that the outlet plate on the opposite of the polymer layer does. This support prevents the bonding plate from warping or deforming the polymer layer portions 420 that span channels in the outlet plate, leaving the polymer layer substantially flat after the bonding is completed.

After the bonding process is complete, the bonding plate must be removed without damaging the polymer layer. To this end, the bonding plate may be covered with a layer of release agent 408 that prevents the bonding plate from adhering to the polymer layer during the bonding process. This release agent may be a low surface energy coating such as a fluoropolymer. Alternatively, the release agent may be applied to the polymer layer. In this case, the release agent may also be a low surface energy coating such as a fluoropolymer.

FIG. 4B depicts another possible embodiment for bonding the polymer layer to the outlet plate. In this embodiment, an adhesive layer 424 is placed between the polymer layer 412 and the outlet plate 416. This adhesive layer bonds the polymer plate to the outlet plate. Suitable film adhesive layers include double sided adhesive tapes having thermoset or thermoplastic adhesive layers on opposite sides of a thermoset or thermoplastic polymer core. Alternatively, the adhesive layer can be a thermoplastic or thermoset adhesive. In yet further alternatives, the adhesive may be dispensed liquid adhesive or a transfer film of liquid adhesive. As in FIG. 3A, the bonding plate 104 and outlet plate 116 are aligned with the polymer plate 412 in between them. Pressure and heat are then applied to the bonding plate, polymer layer, adhesive, and outlet plate until the bonding is complete. Finally, as in FIG. 4A, the bonding plate is removed from the polymer layer to leave a substantially planar polymer layer bonded to the outlet plate.

Figure 4C:
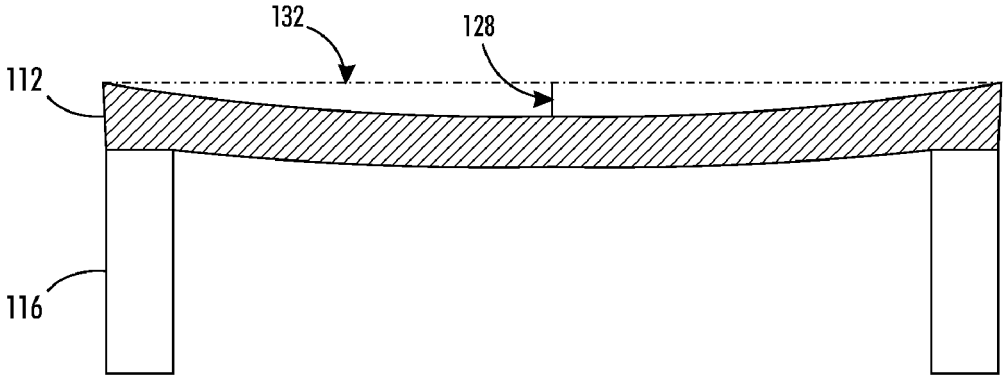
FIG. 4C depicts a polymer layer spanning a channel etched into the outlet plate.
Figure 5A:
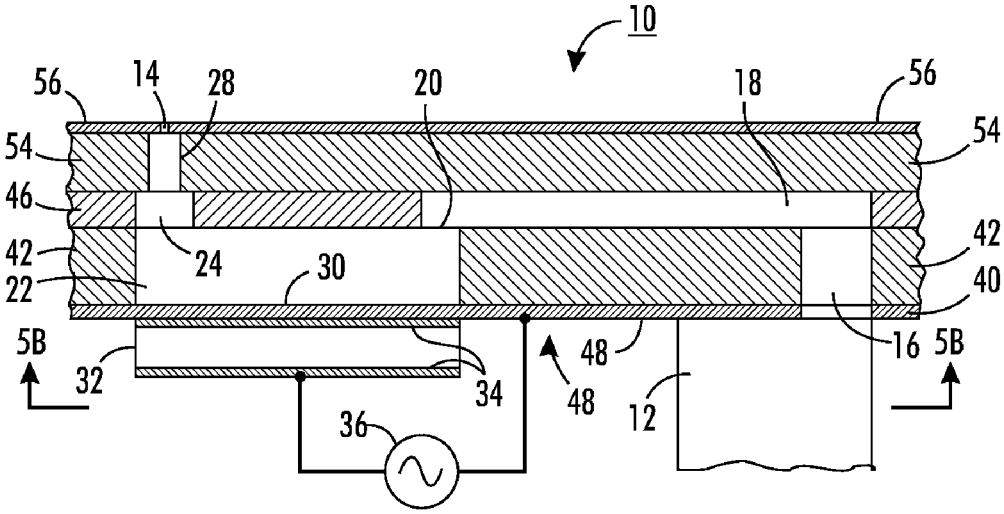
FIG. 5A PRIOR ART
FIG. 5A is a schematic side-cross-sectional view of a prior art embodiment of an inkjet.
Figure 5B:
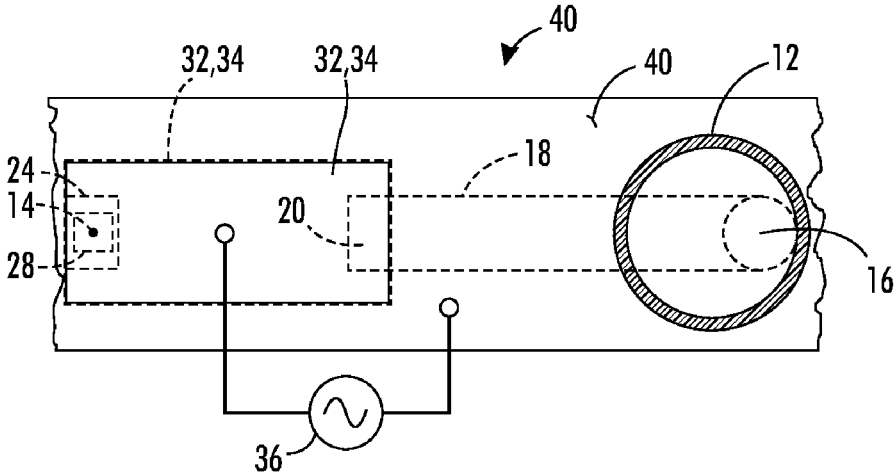
FIG. 5B PRIOR ART
FIG. 5B is a schematic view of the prior art embodiment of the inkjet of FIG. 5A.

FIG. 4C depicts the flatness of the polymer layer 412 spanning a single channel in the outlet plate 416 after the polymer layer has been bound to the outlet plate. The improved bonding process described above preserves the polymer layer's shape such that the maximum deviation 428 from a geometrically straight line across a channel opening in the outlet plate, represented by line 432 in FIG. 4C, does not exceed 1.5 μm.

In each embodiment of FIGS. 4A and 4B, the improved bonding process allows for print heads using longer polymer layers that are at least 20 mm in length. The outlet plate has channels in its surface that carry ink from the print head assembly to apertures formed in the polymer layer. In the embodiments depicted in FIGS. 4A and 4B, the polymer layer is bonded to the outlet plate before apertures are formed in the polymer layer. After the bonding process is completed, one possible embodiment ablates apertures through the polymer layer using the outlet plate as an alignment feature to locate the apertures precisely. This process turns the polymer layers of FIGS. 4A and 4B into the final polymer aperture plate with apertures or nozzles extending through the polymer layer. Other possible embodiments form the apertures in the polymer layer before bonding the polymer layer to the outlet plate. In these embodiments, the apertures in the polymer layer are aligned with the channels in the outlet plate before the polymer aperture layer is bonded to the outlet plate. In the finished print head, ink flows from the outlet plate to the nozzles in the polymer aperture layer and leaves the print head as droplets.

In operation, aperture plates are prepared from polymer material bonded to an outlet plate configured with outlets. Apertures are laser ablated in the polymer layer from the outlet plate side to align the apertures precisely with the channels in the outlet plate. The outlet plate may then be attached to a partially constructed inkjet stack to provide outlet channels and apertures for pressure chambers in the inkjet stack. This bonding rigidly positions the apertures and outlet channels with the pressure chambers to form inkjet ejectors that are aligned more precisely even though the more flexible polymer material was used.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet print head comprising:

a body layer in which a plurality of pressure chambers is configured;

an outlet plate configured with a plurality of channels; and a polymer layer having apertures that are aligned with the channels in the outlet plate, the polymer layer deviating no more than about 1.5 μm on either side of a straight line across an opening in a channel in the outlet plate.

2. The inkjet print head of claim 1 further comprising:

an adhesive layer between the outlet plate and the polymer layer.

3. The inkjet print head of claim 2, the adhesive layer further comprising:

a double sided adhesive tape.

4. The inkjet print head of claim 3, the double sided adhesive tape further comprising:

a thermoset polymer core having a first and a second side; and a first adhesive layer on the first side of the thermoset polymer core; and a second adhesive layer on the second side of the thermoset polymer core.

5. The inkjet print head of claim 4, the first and the second adhesive layers being one of a thermoset adhesive layer and a thermoplastic adhesive layer.

6. The inkjet print head of claim 2, the adhesive layer being one of a thermoset adhesive layer and a thermoplastic adhesive layer.

7. The inkjet print head of claim 3, the double sided adhesive tape further comprising:

a thermoplastic polymer core having a first and a second side; and a first adhesive layer on the first side of the thermoplastic polymer core; and a second adhesive layer on the second side of the thermoplastic polymer core.

8. The inkjet print head of claim 7, the first and the second adhesive layers being one of a thermoset adhesive layer and a thermoplastic adhesive layer.

9. The inkjet print head of claim 1 further comprising:

a flexible diaphragm plate proximate the body layer; and a layer of piezoelectric transducers, each piezoelectric transducer having a bottom surface attached to the diaphragm plate.

10. The inkjet print head of claim 1, the polymer layer further comprising:

a self-adhesive thermoplastic layer.

11. The inkjet print head of claim 10, the self-adhesive thermoplastic layer further comprising:

a polyimide layer.

12. The inkjet print head of claim 1, the polymer layer being one of a polyetherether ketone, a polysulfone, a polyester, a polyethersulfone, a polyimideamide, a polyamide, and a polyethylenenaphthalene layer.

13. The inkjet print head of claim 1 wherein the outlet plate is a stainless steel plate in which the channels have been etched.

* * * * *